US006472064B1

(12) United States Patent
Ogawa et al.

(10) Patent No.: US 6,472,064 B1
(45) Date of Patent: Oct. 29, 2002

(54) TAB FOR FIXING PAPER WEB END PORTION OF PAPER ROLL

(75) Inventors: Yukio Ogawa, Chigasaki (JP); Katsumi Aoki, Yokohama (JP); Mitsuo Kitai, Yokohama (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/408,517

(22) Filed: Sep. 30, 1999

(30) Foreign Application Priority Data

Mar. 31, 1999 (JP) ..... 11-091553

(51) Int. Cl.[7] ..... B32B 7/12; B32B 9/00

(52) U.S. Cl. ..... 428/343; 428/40.1; 428/41.8; 428/42.3; 428/906; 428/131; 428/136

(58) Field of Search ..... 428/40.1, 41.8, 428/42.3, 343, 906, 136, 131, 132, 134; 152/526

(56) References Cited

U.S. PATENT DOCUMENTS

| | | | | |
|---|---|---|---|---|
| 5,512,343 A | * | 4/1996 | Shaw | 428/40 |
| 5,595,804 A | * | 1/1997 | Korbel | 428/57 |
| 6,177,163 B1 | * | 1/2001 | Blok et al. | 428/40.1 |

FOREIGN PATENT DOCUMENTS

| | | |
|---|---|---|
| JP | 4-117854 | 10/1992 |
| JP | 5-12440 | 2/1993 |
| JP | 10-114452 | 5/1998 |

* cited by examiner

*Primary Examiner*—Terrel Morris
*Assistant Examiner*—Alexis Wachtel
(74) *Attorney, Agent, or Firm*—Armstrong, Westerman & Hattori, LLP

(57) ABSTRACT

A tab for fixing a paper web end portion of a paper roll includes a substantially parallelogram-shaped base sheet having two diagonally opposite acute angles. A plurality of linear, discontinuous cuts are formed on the base sheet in parallel with two opposite sides of the base sheet to thereby define a first portion in cooperation with one of the two opposite sides and a second portion in cooperation with the other side. The cuts extend to at least one of other two opposite sides of the base sheet. Adhesive is applied to the first and second portions on the same surface such that an appropriate nonadhesive portion is formed between adhesive applied onto the first portion and adhesive applied onto the second portion. A release sheet having a size greater than that of the tab is attached to an adhesive-applied side of the tab such that a portion thereof is projected beyond the profile of the tab. Alternatively, the release sheet assumes the form of tape. The tabs are arranged on the release sheet tape in the longitudinal direction of the tape. The release sheet tape is rolled up into a tab feed roll.

4 Claims, 5 Drawing Sheets

TAB FOR FIXING PAPER WEB END PORTION OF PAPER ROLL

BACKGROUND OF THE INVENTION

1. Field of the Invention

The present invention relates to a tab for temporarily fixing a paper web end portion of a paper roll for use with, for example, a rotary press, in order to prevent unwinding of the paper roll.

2. Description of the Related Art

In, for example, a rotary press, a paper web is fed downstream from a paper roll loaded in a web feeder. When a paper web end of the paper roll is approached, a paper web end portion of a new paper roll is affixed to the currently fed paper web, so that the feed of paper web is not interrupted. In order to achieve this affixing, the paper web end portion of the new paper roll is provided with a special device.

Specifically, as shown in FIG. 7, after a paper web end of a paper roll 52 is cut straight or into a chevron shape, an end portion 50 of paper web of the paper roll 52 is affixed to the surface of the paper roll 52 by means of tabs t in order to prevent unwinding of the paper roll 52. Further, a pressure-sensitive double-sided adhesive tape 51 is affixed to the end portion 50 along its end edge.

Conventional tabs used to temporarily fix the end portion of a paper roll as described above are disclosed in, for example, Japanese Utility Model Application Laid-Open (kokai) Nos. 4-117854 and 5-12440 and Japanese Patent Application Laid-Open (kokai) No. 10-114452.

FIGS. 8A and 8B show a tab ta disclosed in Japanese Utility Model Application Laid-Open (kokai) No. 4-117854 "Tab for Fixing Paper Web End Portion of Paper Roll." In this tab ta, a nonadhesive portion 66 is formed at a central portion of a base sheet 53, and adhesive layers 54 and 55 are provided between the nonadhesive portion 66 and the upper edge of the base sheet 53 and between the nonadhesive portion 66 and the lower edge of the base sheet 53, respectively. Further, perforations 56 are formed in the nonadhesive portion 66 such that the perforations extend at intervals of, for example, about 1 mm between the side edges of the nonadhesive portion 66.

The adhesive layers 54 and 55 of a plurality of tabs ta are affixed to the paper roll 52 such that the perforations 56 are aligned with the end edge of the end portion 50 of the paper roll 52, thereby temporarily fixing the end portion 50 on the paper roll 52. When the paper web of a new paper roll 52 is to be joined to the paper web currently being fed (hereinafter called the "currently fed paper web"), the pressure-sensitive double-sided adhesive tape 51 adhering to the end portion 50 of the new paper roll 52 is affixed to the currently fed paper web. As a result, each of the base sheets 53 is torn apart, along the perforations 56, into upper and lower pieces, so that the end portion 50 of the new paper roll 52 is released from temporary fixation.

FIGS. 9A and 9B show a tab tb disclosed in Japanese Patent Application Laid-Open (kokai) No. 10-114452 "Tape to Prevent Unwinding of Paper Web End of Paper Roll." This tab tb is formed of an adhesive tape 57, and a plurality of slits 58 are formed at equal intervals along the opposite side edges of the adhesive tape 57.

A plurality of tabs tb are affixed to the paper roll 52 such that the side edges thereof cross the end edge of the end portion 50 of the paper roll 52 substantially perpendicularly, thereby temporarily fixing the end portion 50 on the paper roll 52. When the paper web of a new paper roll 52 is to be joined to currently fed paper web, the pressure-sensitive double-sided adhesive tape 51 adhering to the end portion 50 of the new paper roll 52 is affixed to the currently fed paper web. As a result, each of the adhesive tapes 57 serving as the tabs ta is torn apart, along appropriate slits 58, into upper and lower pieces, so that the end portion 50 of the new paper roll 52 is released from temporary fixation.

FIGS. 10A and 10B show a tab tc disclosed in Japanese Utility Model Application Laid-Open (kokai) No. 5-12440 "Tab for Temporarily Fixing Paper Web End Portion of Paper Roll." In this tab tc, slits 60 are provided at a central portion between the upper and lower edges of a base sheet 59 and extend at appropriate intervals between the side edges thereof. An upper piece 61 is defined between the slits 60 and the upper edge of the base sheet 59, and a lower piece 62 is defined between the slits 60 and the lower edge of the base sheet 59. Adhesive layers 63 and 64 are provided on the back surfaces of the upper and lower pieces 61 and 62, respectively, in order to temporarily fix an end portion of a paper roll. Further, an adhesive layer 65 is provided on the front surface of the upper piece 61 in order to join paper webs.

The tab tc is mainly used for fixation of the vertex of an unillustrated chevron-shaped end portion of a paper roll. The adhesive layers 63 and 64 of the tab tc are affixed to the paper roll such that the slits 60 are aligned with the vertex of the chevron-shaped end portion of the paper roll, thereby temporarily fixing the chevron-shaped end portion on the paper roll. When the paper web of a new paper roll is to be joined to the currently fed paper web, the adhesive layer 65 is affixed to the currently fed paper web. As a result, the base sheet 59 is torn apart, along the slits 60, into the upper and lower pieces 61 and 62, so that the chevron-shaped end portion of the new paper roll is released from temporary fixation.

The tab ta disclosed in Japanese Utility Model Application Laid-Open (kokai) No. 4-117854 involves the following problem. When the paper roll 52 of FIG. 7—whose straight end portion 50 is temporarily fixed by an appropriate number of tabs ta of FIGS. 8A and 8B arranged at appropriate intervals—is rotated acceleratedly and subjected to joining to the currently fed paper web by means of the pressure-sensitive double-sided adhesive tape 51, a tensile force is concentrated on the perforations 56 of all the tabs ta.

The perforations 56 of each tab ta subjected to the tensile force tend to be torn intermittently. Also, when the tensile force is exerted concurrently on all the tabs ta, the tabs ta tend to be torn intermittently. Accordingly, impact forces associated with the tearing of the individual tabs ta may not be exerted uniformly on the currently fed paper web with respect to its width direction; in other words, the impact forces may be exerted on the currently fed paper web in an unbalanced manner. As a result, the end portion 50 of the paper roll 52 and the currently fed paper wed adhering to the end portion 50 may both tear or deform, potentially failing to join together. Since the tabs ta adhering to the paper roll 52 are not torn smoothly as described above, use of the tabs ta involves poor reliability in joining paper webs.

In order to sequentially tear a plurality of tabs ta, a paper web end of the paper roll 52 may be cut obliquely with respect to the axis of the paper roll 52, and the tabs ta may be affixed to the oblique end portion of the paper roll 52. For example, as shown in FIG. 12, a plurality of tabs ta may be affixed to an oblique end portion 67 such that the perforations 56 thereof are substantially in parallel with the end portion 67, thereby temporarily fixing the end portion 67 on the paper roll 52. In this case, however, during the accelerated rotation of the paper roll 52, an air current arises around the rotating paper roll 52; thus, the resultant wind tends to enter beneath the nonadhesive portions 66 of the tabs ta. This causes entry of the wind beneath the end portion 67. As a result, the end portion 67 floats up in the air, and the tabs ta may be torn out before the joining of paper webs is completed, potentially resulting in unwinding of the paper roll 52.

In order to avoid the above-mentioned influence of an air current which arises around the rotating paper roll 52 during the accelerated rotation of the paper roll 52 and to sequentially tear a plurality of tabs ta adhering to the paper roll 52, as shown in FIG. 11, the tabs ta may be affixed to the oblique end portion 67 such that the perforations 56 thereof are in parallel with the axis of the paper roll 52. During the joining of paper webs, the oblique end portion 67 is affixed, successively from a leading edge toward a trailing edge with respect to the direction of rotation of the paper roll 52, to the currently fed paper wed. Thus, a tensile force is exerted on the tabs ta sequentially from the leading tab ta toward the trailing tab ta with respect to the direction of rotation of the paper roll 52, so that the tabs ta are torn sequentially.

However, since a difference substantially corresponding to the inclination angle of the end portion 67 exists between the direction of the tensile force acting along the inclined end portion 67 and the direction of the perforations 56 of the tab ta, the perforations 56 of the tab ta are torn forcedly, resulting in unsmooth tearing of the tab ta.

Thus, the tab ta is not suited for use in temporarily fixing an obliquely cut end portion of a paper roll.

The tab tb disclosed in Japanese Patent Application Laid-Open (kokai) No. 10-114452 involves the following problem. When the paper roll 52 of FIG. 7—whose end portion 50 is temporarily fixed by an appropriate number of tabs tb of FIGS. 9A and 9B arranged at appropriate intervals—is rotated acceleratedly and subjected to joining to the currently fed paper web by means of the pressure-sensitive double-sided adhesive tape 51, a tensile force is concentrated on the slits 58 formed along the opposite side edges of the tapes 57 serving as the tabs tb.

However, the tab tb does not have a nonadhesive portion on the adhesive side thereof. Therefore, when the tab tb is torn, in addition to the strength of the material of the tab tb, the adhesion force resulting from adhesion of the tapes 57 to the underling paper surface acts against the tearing of the tab tb. Thus, even when the tensile force is exerted concurrently on the tabs tb, the tabs tb tend to be torn intermittently. Accordingly, impact forces associated with the tearing of the individual tabs tb may not be exerted uniformly on the currently fed paper web with respect to its width direction; in other words, the impact forces may be exerted on the currently fed paper web in an unbalanced manner. As a result, the end portion 50 of the paper roll 52 and the currently fed paper web adhering to the end portion 50 may tear or deform, potentially failing to join together. Since the tabs tb adhering to the paper roll 52 are not torn smoothly as described above, use of the tabs tb involves poor reliability in joining paper webs.

In order to sequentially tear a plurality of tabs tb, a paper web end of the paper roll 52 may be cut obliquely with respect to the axis of the paper roll 52, and the tabs tb may be affixed to the oblique web end portion of the paper roll 52 such that the upper and lower edges thereof (FIG. 9A) are substantially in parallel with the oblique web end portion, thereby temporarily fixing the oblique web end portion on the paper roll 52. In this case, however, the tab tb does not have a nonadhesive portion on the adhesive side thereof. Therefore, when the tab tb is torn, in addition to the strength of the material of the tab tb, the adhesion force resulting from adhesion of the tapes 57 to the underling paper surface acts against the tearing of the tab tb. Thus, a relatively large tensile force is required to tear the tabs tb adhering to the paper roll 52. As a result, the joining of paper webs may fail due to a failure to tear the tabs tb; therefore, the oblique end portion may not be reliably released from temporary fixation.

The tab tc disclosed in Japanese Utility Model Application Laid-Open (kokai) No. 5-12440 involves the following problem. When the tab tc of FIGS. 10A and 10B is torn into the upper piece 61 and the lower piece 62, the tearing force is exerted on the tab tc in a direction perpendicular to the slits 60. Accordingly, tears may develop from the opposite ends of the slit 60 in a direction intersecting with the slit 60 to reach the adhesive layers 63 and 65 of the upper piece 61. As a result, the upper piece 61 and the lower piece 62 may not be separated from each other; therefore, a web end portion of a paper roll may not be reliably released from temporary fixation.

SUMMARY OF THE INVENTION

An object of the present invention is to solve the above-mentioned problems involved in the conventional tabs and to provide a tab for fixing a paper web end portion of a paper roll, which tab can be attached to an obliquely cut end portion to be substantially perpendicular to the axial direction of the paper roll and substantially parallel to the end portion, so that the effective width of the tab is increased in order to securely fixed the end portion, thereby preventing unwinding of the end portion during accelerated rotation of the paper roll.

Another object of the present invention is to provide a tab for fixing a paper web end portion of a paper roll which permits smooth release of the paper web end portion from temporary fixation at the time of the joining of paper webs.

Still another object of the present invention is to provide a tab for fixing a paper web end portion of a paper roll which can be compactly arranged on a release sheet at short intervals so that the tabs arranged on the release sheet can be efficiently applied onto the paper roll by use of an automatic applicator.

To achieve the above objects, the present invention provides a tab for fixing a paper web end portion of a paper roll, comprising a substantially parallelogram-shaped base sheet having two diagonally opposite acute angles. A plurality of linear, discontinuous cuts are formed on the base sheet in parallel with two opposite sides of the base sheet to thereby define a first portion in cooperation with one of the two opposite sides and a second portion in cooperation with the other side. The cuts extend to at least one of other two opposite sides of the base sheet (the cut extending to the side of the base sheet is hereinafter referred to as an "open cut"). The tab further comprises adhesive layers applied to the first and second portions on the same surface such that an appropriate nonadhesive portion is formed between the adhesive layers and that a predetermined space is formed between the discontinuous cuts and each of said adhesive layers.

Through employment of the above parallelogram-shaped strip, the two sides of the tab in parallel with the cuts become longer than the width of the tab (the distance between the other two sides of the tab). Since the tab is affixed to a paper roll such that a line of cuts are aligned with the edge of the paper web end portion of the paper roll, an effective width of the tab becomes wider than the actual width of the tab. Thus, the paper web end portion of the paper roll is temporarily fixed in a reliable manner, so that the paper web end portion is not released from temporary fixation when the paper roll is rotated acceleratedly for the joining of paper webs.

The paper web end portion of the paper roll is affixed to the currently fed paper web and thus is released from temporary fixation, successively from a leading edge toward a trailing edge with respect to the direction of rotation of the paper roll. Since the tab is affixed to the paper roll in such an orientation that an open cut formed therein is located on the leading-edge side, tearing starts from the open cut and proceeds along a line of cuts.

Accordingly, even when the space between cuts is rendered relatively large in order to impart stiffness to the tab, the tab is readily torn along a line of cuts. Thus, the paper web end portion is smoothly released from temporary fixation.

Preferably, a release sheet having a size greater than that of the base sheet is attached to an adhesive-applied side of the base sheet such that a portion thereof is projected beyond the profile of the base sheet.

Employment of the above release sheet facilitates handling of the tab.

Preferably, the release sheet assumes the form of tape. The base sheets are arranged on the release sheet tape in the longitudinal direction of the tape. The release sheet tape is rolled up into a tab feed roll.

Employment of the above tab feed roll facilitates feed of the tabs.

Preferably, the base sheets are arranged on the release sheet tape in the longitudinal direction of the tape and such that the images of the adjacent base sheets projected in the width direction of the release sheet tape do not overlap each other. This feature facilitates application of the tabs performed by an automatic applicator, since the tab is released from the release sheet tape without interfering with the following tab. Further preferably, at least one of two acute corners of the base sheet is cut off. This feature enables the tabs to be arranged on the release sheet tape at shorter intervals, so that the release sheet tape of a predetermined length can carry a larger number of tabs. As a result, the automatic applicator is less frequently loaded with a tab feed roll, thereby improving the efficiency of the temporary-fixation work.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will next be described in detail with reference to the drawings.

Figure 1:
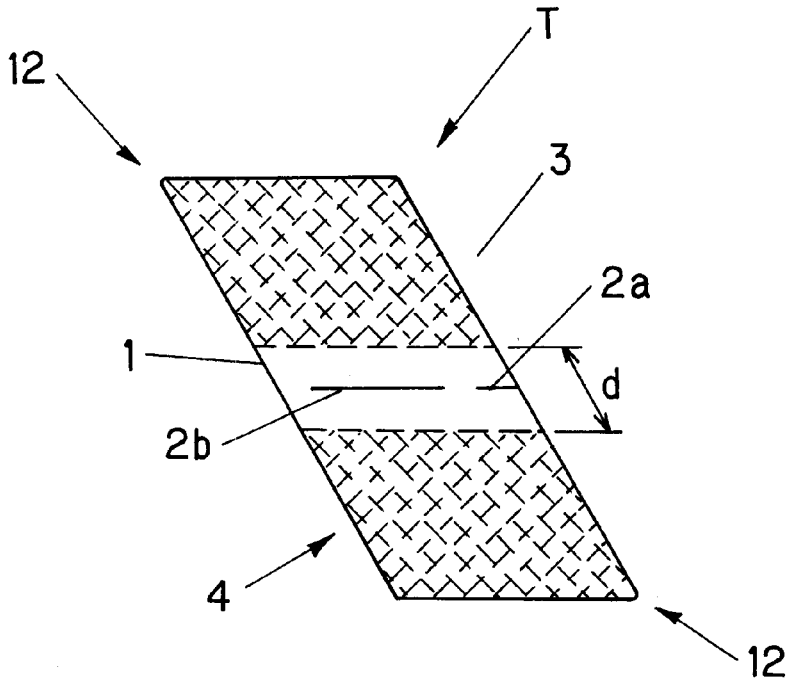
FIG. 1 is a plan view showing the adhesive side of a tab for fixing a paper web end portion of a paper roll according to an embodiment of the present invention.
Figure 2:
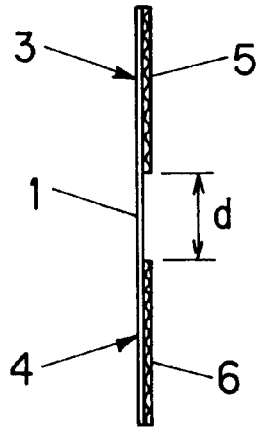
FIG. 2 is a side view of the tab of FIG. 1.

As shown in FIGS. 1 and 2, a tab T for fixing a paper web end portion of a paper roll includes a base sheet 1 and adhesive layers 5 and 6. The adhesive layers 5 and 6 are located on the opposite sides of a line of discontinuous cuts 2*a* and 2*b* and are distant from the line by an appropriate distance.

The base sheet 1 assumes a substantially parallelogrammatic shape having two opposite minor sides of, for example, 4 to 7 centimeters and two opposite major sides, whose length is about 2 or less times that of the minor sides. The discontinuous cuts 2*a* and 2*b* are arranged substantially on the centerline between the minor sides of the base sheet 1 and are thus substantially in parallel with the minor sides. Therefore, the discontinuous cuts 2*a* and 2*b* are directed obliquely to the major sides of the base sheet 1.

The discontinuous cuts 2*a* and 2*b* may be arranged substantially on the centerline between the major sides of the base sheet 1, so that the cuts 2*a* and 2*b* are directed obliquely to the minor sides of the base sheet 1.

The discontinuous cuts 2*a* and 2*b* are arranged on a straight line and are spaced by, for example, 0.5 to 1.0 centimeter. The cut 2*a* serves as an open cut and extends to the major side of the base sheet 1. One end of the cut 2*b*, serving as a closed cut, is distant from the facing major side of the base sheet 1 by 0.5 to 1.0 centimeter.

The base sheet 1 is partially cut by the cuts 2*a* and 2*b* into a first portion 3 and a second portion 4. The first portion 3 and the second portion 4 are connected together by means of uncut portions located between the major side of the base sheet 1 and the cut 2*b* and between the cuts 2*a* and 2*b*.

Adhesive is applied onto the back surfaces of the first and second portions 3 and 4 to thereby form the adhesive layers 5 and 6, while a nonadhesive portion is formed between the adhesive layers 5 and 6. The boundary between the adhesive layer 5 (6) and the nonadhesive portion is distant from a line of the cuts 2*a* and 2*b* by an appropriate distance of d/2. In other words, the nonadhesive portion extends by an appropriate dimension of d between the adhesive layers 5 and 6, while a line of the cuts 2*a* and 2*b* serves as the centerline of the nonadhesive portion.

A release sheet is attached onto the side of the tab T on which the adhesive layers 5 and 6 are formed, thereby protecting the adhesive layers 5 and 6. The release sheet may assume a shape identical to that of the tab T or a shape greater in size than the tab T so that a portion of the release sheet is projected beyond an edge of the tab T for convenience of peeling.

Alternatively, the release sheet may assume the form of a release sheet tape 10, on which the tabs T are arranged with the adhesive layers 5 and 6 facing down. The release paper tape 10 is rolled up into a tab feed roll 11.

Figure 3:
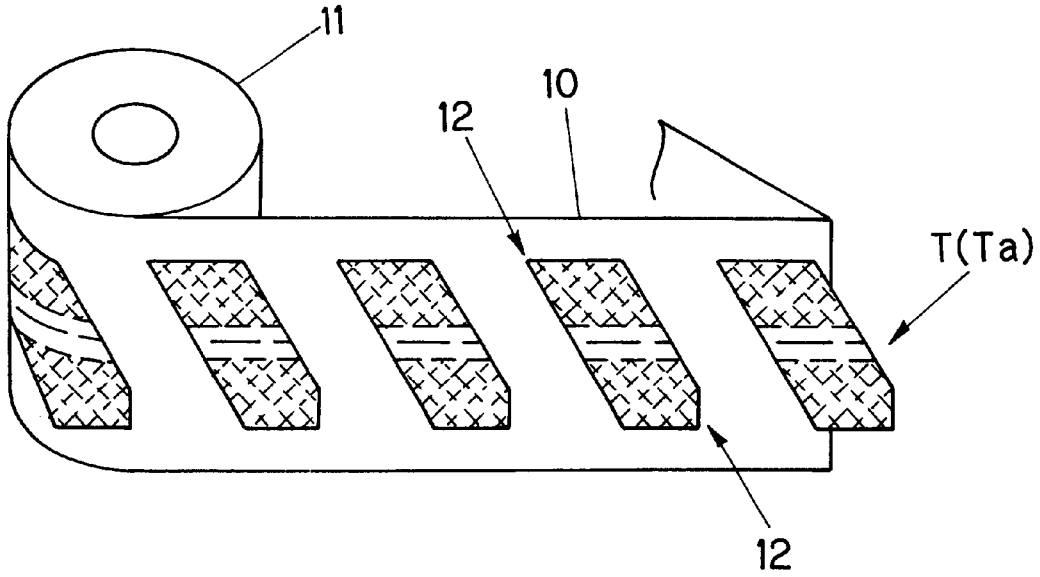
FIG. 3 is a perspective view showing a release sheet tape of a tab feed roll on which tabs for fixing a paper web end portion of a paper roll according to another embodiment of the present invention are arranged.
Figure 4:
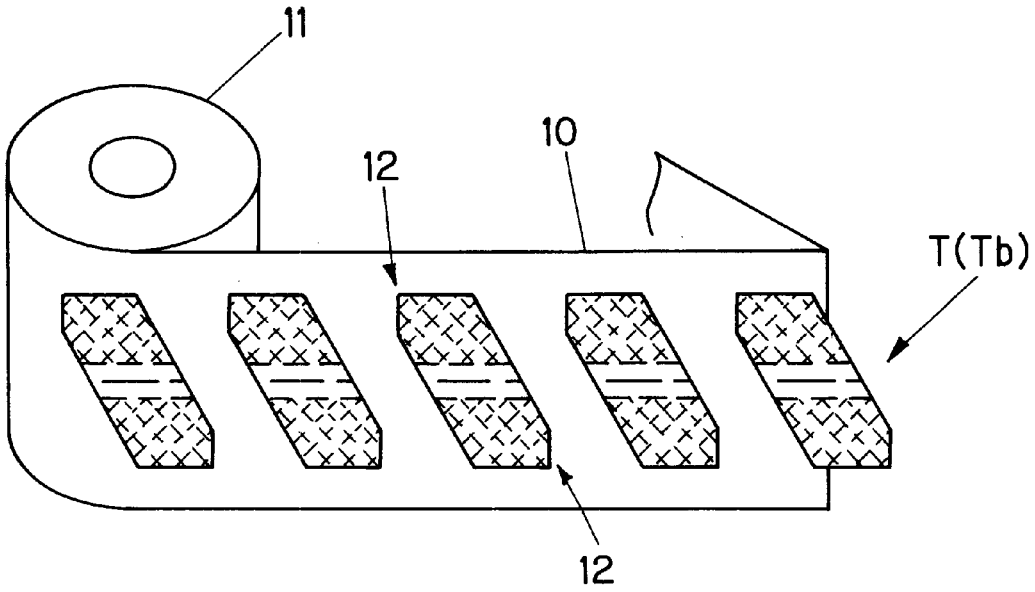
FIG. 4 is a perspective view showing a release sheet tape of a tab feed roll on which tabs for fixing a paper web end portion of a paper roll according to still another embodiment of the present invention are arranged.

In order to facilitate the peeling of the tabs T from the release sheet tape 10, preferably, the tabs T are arranged on the release sheet tape 10 at appropriate intervals. Particularly preferably, as shown in FIGS. 3 and 4, the tabs T are arranged on the release sheet tape 10 such that the minor sides of the tabs T are in parallel with the side edges of the release sheet tape 10 and such that the images of the adjacent tabs T projected in the width direction of the release sheet tape 10 do not overlap each other; i.e., the adjacent tabs T do not overlap each other as viewed in the width direction of the release sheet tape 10. This arrangement enables the tabs T to be peeled one by one from the release sheet tape 10 by folding the release sheet tape 10 as shown in FIGS. 3 and 4, without interfering with the subsequent tab T.

In combination with the above-described arrangement of the tabs T, one acute corner 12 (FIG. 3), preferably the two opposite acute corners 12 (FIG. 4), of each of the parallelogram-shaped tabs T is cut off along a line perpendicular to the minor side of the tab T. This enables reduction of arrangement intervals of the tabs T (Ta and Tb) on the release sheet tape 10. That is, the release sheet tape 10 of a predetermined length can carry a larger number of the tabs T (Ta and Tb) . As a result, an automatic applicator is less frequently loaded with the tab feed roll 11, thereby improving the efficiency of the temporary-fixation work.

Figure 5:
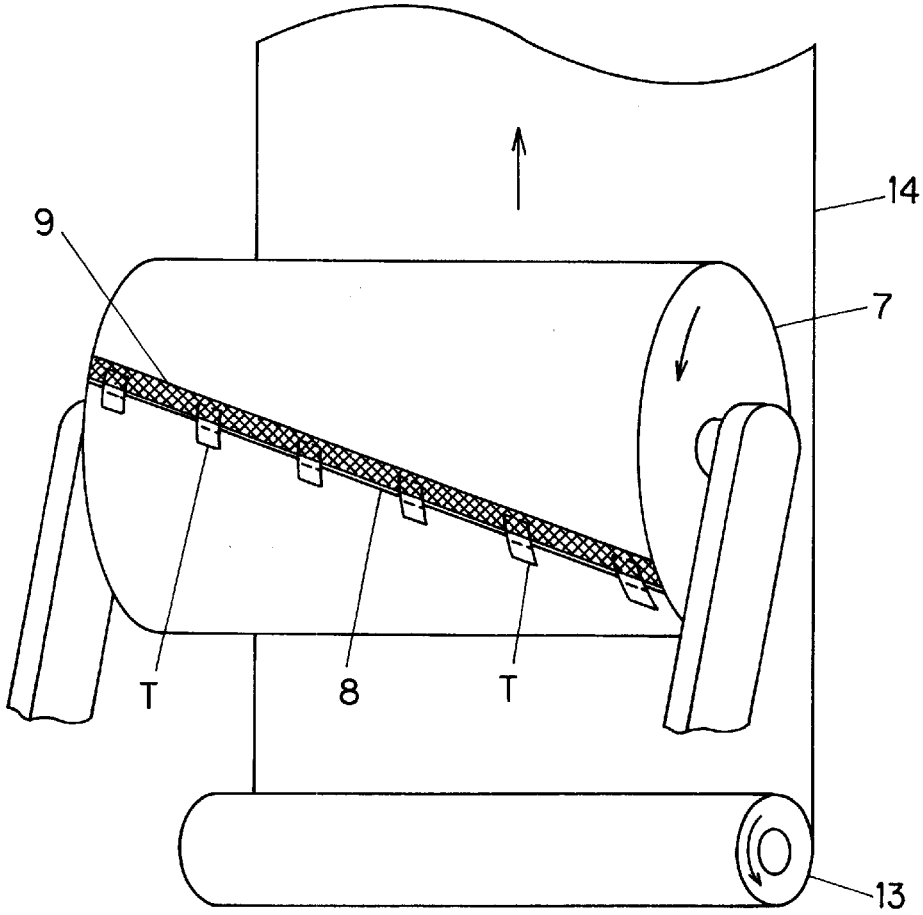
FIG. 5 is a perspective view showing a paper roll whose paper web end portion is temporarily fixed by use of the tabs according to any one of the embodiments.
Figure 6:
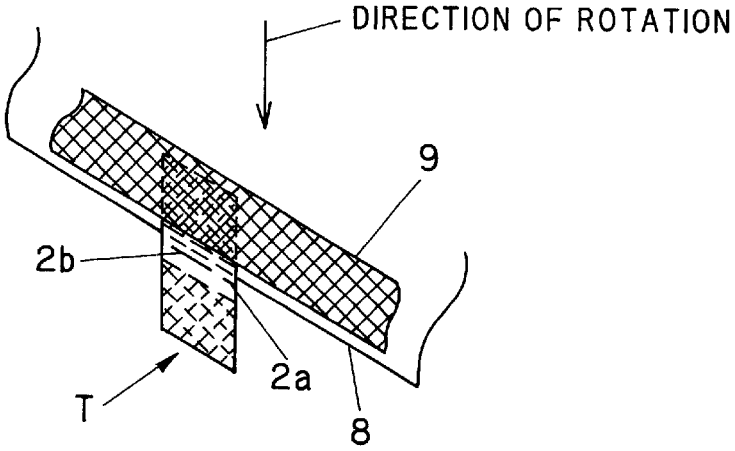
FIG. 6 is an enlarged partial view of FIG. 5.
Figure 7:
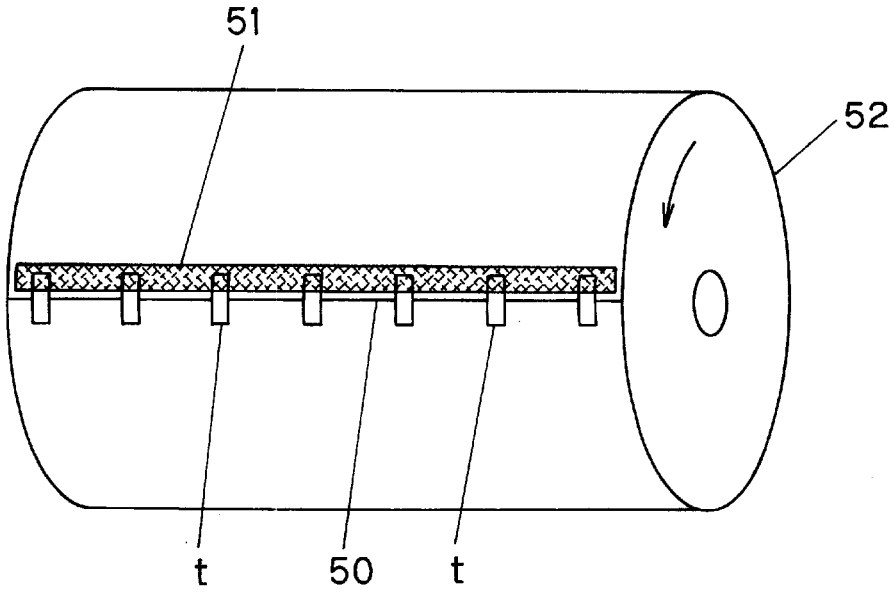
FIG. 7 PRIOR ART
FIG. 7 is a schematic view showing a first exemplary state in which a paper web end portion of a paper roll is temporarily fixed by use of conventional tabs.
Figure 8A:
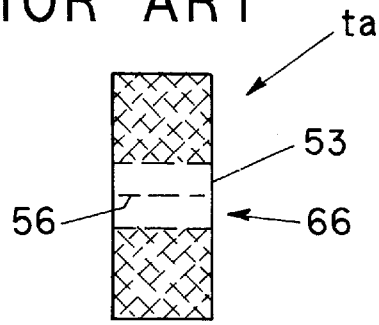
FIG. 8A PRIOR ART
FIG. 8A is a plan view of a first conventional tab as viewed from its adhesive side.
Figure 8B:
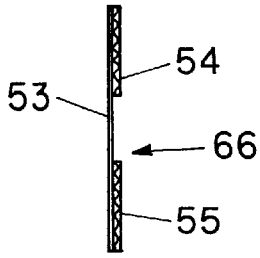
FIG. 8B PRIOR ART
FIG. 8B is a side view of the conventional tab of FIG. 8A.
Figure 9A:
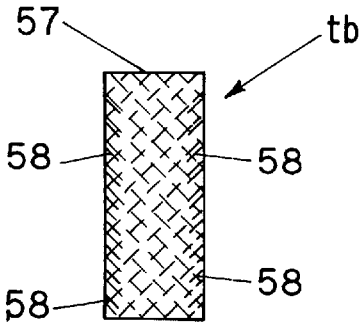
FIG. 9A PRIOR ART
FIG. 9A is a plan view of a second conventional tab as viewed from its adhesive side.
Figure 9B:
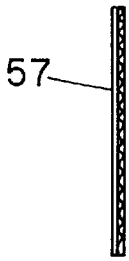
FIG. 9B PRIOR ART
FIG. 9B is a side view of the conventional tab of FIG. 9A.
Figure 10A:
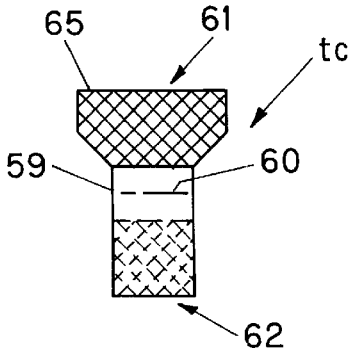
FIG.10A PRIOR ART
FIG. 10A is a plan view of a third conventional tab as viewed from its adhesive side.
Figure 10B:
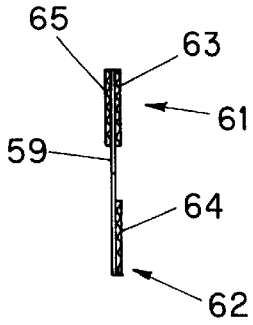
FIG.10B PRIOR ART
FIG. 10B is a side view of the conventional tab of FIG. 10A.
Figure 11:
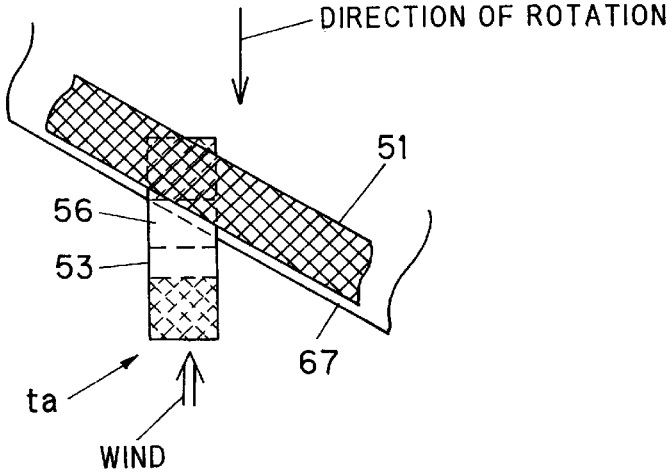
FIG.11 PRIOR ART
FIG. 11 is a schematic view showing a second exemplary state in which a paper web end portion of a paper roll is temporarily fixed by use of the tab of FIG. 8A.
Figure 12:
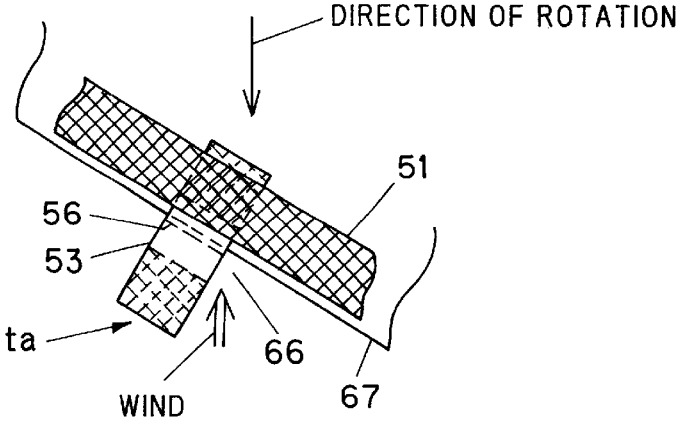
FIG.12 PRIOR ART
FIG. 12 is a schematic view showing a third exemplary state in which a paper web end portion of a paper roll is temporarily fixed by use of the tab of FIG. 8A.

A paper web end portion 8 of a paper roll 7 is temporarily fixed by the above-described tabs T as shown in FIGS. 5 and 6.

A paper web end of the paper roll 7 is cut obliquely linearly to form the paper web end portion 8. The direction and angle of inclination of the obliquely cut paper web edge is determined such that, when the tab T is affixed to paper roll 7 with the major sides thereof being in parallel with the side edges of the paper web, the cuts 2*a* and 2*b* become substantially in parallel with the obliquely cut paper web edge. That is, the angle of inclination of the obliquely cut paper web edge is equal to or substantially equal to the complementary angle of the angle of the acute corner 12 of the tab T.

The individual tabs T are peeled from the release sheet tape 10 and are then affixed to the paper roll 7 such that the cuts 2*a* and 2*b* are aligned with the end edge of the paper web end portion 8 and such that the open cut 2*a* is located on the side of the acute corner of the paper web end portion 8. In other words, a plurality of tabs T are. affixed to the paper roll 7 such that the first portion 3 is affixed to the paper web end portion 8, while the second portion 4 is affixed to the surface of the paper roll 7 on which the paper web end portion 8 is superposed.

Further, a pressure-sensitive double-sided adhesive tape 9, which is intended to effect the joining of paper webs, is affixed to the paper web end portion 8 along its end edge. Accordingly, the first portion 3 of the tab T is sandwiched between the pressure-sensitive double-sided adhesive tape 9 and the paper web end portion 8.

The joining of paper webs is effected when the end of a paper web 14 of a paper roll 13 in current use is approached. The new paper roll 7 is rotated acceleratedly so that the circumferential speed thereof becomes equal to the traveling speed of the paper web 14. Then, the paper roll 7 is pressed against the currently fed paper web 14 of the paper roll 13. Thus, the pressure-sensitive double-sided adhesive tape 9 is affixed to the paper web 14. As a result, the paper web end portion 8 of the paper roll 7 begins to travel with the paper web 14.

Accordingly, the paper web end portion 8 separates from the surface of the paper roll 7, successively from its acute corner toward its other corner. The tab T is torn along the cuts 2*a* and 2*b*. In this case, since the tearing of the tab T starts from the open cut 2*a*, the first portion 3 and the second portion 4 are separated from each other easily and reliably even when a relatively large space exists between the cuts 2*a* and 2*b* or between the major side of the tab T and the cut 2*b*.

Obviously, numerous modifications and variations of the present invention are possible in light of the above teachings. It is therefore to be understood that within the scope of the appended claims, the present invention may be practiced otherwise than as specifically described herein.

What is claimed is:

1. A tab for fixing a paper web end portion of a paper roll, comprising: a base sheet of a substantially parallelogrammatic shape having two diagonally opposite acute angles, a plurality of linear, discontinuous cuts being formed on said base sheet in parallel with two opposite sides of said base sheet to thereby define a first portion having one of the two opposite sides and a second portion having the other side, one of the cuts, an open cut, extending to one of the other two opposite sides of said base sheet and the cut being closest to the other of the other two opposite sides, a closed cut, being distant therefrom; and adhesive layers applied onto the first and second portions on the same surface such that an appropriate nonadhesive portion is formed between said adhesive layer on the first portion and said adhesive layer on the second portion and the discontinuous cuts being a predetermined distance from the boundaries between each of said adhesive layers and said non-adhesive portions.

2. A tab for fixing a paper web portion of a paper roll according to claim 1, wherein a release sheet having a size greater than that of said base sheet is attached to an adhesive-applied side of said base sheet such that a portion thereof is projected beyond the profile of said base sheet.

3. A tab for fixing a paper web end portion of a paper roll according to claim 2, wherein the release sheet assumes the form of tape, and said base sheets are arranged on a tape of the release sheet in a longitudinal direction of the tape and such that the images of said adjacent base sheets projected in the width direction of the tape do not overlap each other.

4. A tab for fixing a paper web end portion of a paper roll, comprising:

a base sheet of a substantially parallelogrammatic shape having two diagonally opposite acute angles, a plurality of linear, discontinuous cuts being formed on said base sheet in parallel with two opposite sides of said base sheet to thereby define a first portion having one of the two opposite sides and a second portion having the other side, one of the cuts extending to one of the other two opposite sides of said base sheet; and adhesive layers applied onto the first and second portions on the same surface such that an appropriate nonadhesive portion is formed between said adhesive layer on the first portion and said adhesive layer on the second portion and the discontinuous cuts being a predetermined distance from the boundaries between each of said adhesive layers and said non-adhesive portions; wherein a release sheet having a size greater than that of said base sheet is attached to an adhesive-applied side of said base sheet such that a portion thereof is projected beyond the profile of said base sheet, the release sheet assumes the form of tape, and said base sheets are arranged on a tape of the release sheet in a longitudinal direction of the tape and such that the images of said adjacent base sheets projected in the width direction of the tape do not overlay each other, and at least one of two acute comers of said base sheet is cut off.

* * * * *